United States Patent [19]

Shestag et al.

[11] Patent Number: 4,827,269

[45] Date of Patent: May 2, 1989

[54] APPARATUS TO MAINTAIN ARBITRARY POLARIZATION STABILIZATION OF AN ANTENNA

[75] Inventors: Lowell N. Shestag, Salt Lake City; John W. Zscheile, Jr., Farmington; Alan E. Lundquist, Salt Lake City; Glen S. Kirkpatrick, Centerville, all of Utah

[73] Assignee: Unisys Corporation, Blue Bell, Pa.

[21] Appl. No.: 882,838

[22] Filed: Jul. 7, 1986

[51] Int. Cl.[4] ..... H01Q 3/00

[52] U.S. Cl. ..... 343/766; 343/761; 343/763

[58] Field of Search ..... 343/766, 757, 763, 761; 333/133

[56] References Cited

U.S. PATENT DOCUMENTS

| | | | |
|---|---|---|---|
| 2,571,129 | 10/1951 | Hansen | 343/766 |
| 2,881,432 | 4/1959 | Hatkin | 343/766 |
| 3,019,429 | 1/1962 | Harnois | 343/766 |
| 3,317,858 | 5/1967 | Tagawa | 333/133 |
| 3,375,523 | 3/1968 | Laibson | 343/766 |
| 3,519,960 | 1/1970 | Onoe et al. | 333/133 |
| 4,173,762 | 11/1979 | Thompson et al. | 343/761 |
| 4,639,695 | 1/1987 | Mariani et al. | 333/133 |
| 4,656,484 | 4/1987 | Brown et al. | 343/761 |

*Primary Examiner*—William L. Sikes
*Assistant Examiner*—Hoanganh Le
*Attorney, Agent, or Firm*—G. Donald Weber, Jr.; Glenn W. Bowen

[57] ABSTRACT

An apparatus for maintaining an arbitrary orientation of the polarization of an antenna, such as an airborne microwave antenna, by using antenna pointing information and platform (aircraft) attitude information to position the input/feed signal.

17 Claims, 1 Drawing Sheet

APPARATUS TO MAINTAIN ARBITRARY POLARIZATION STABILIZATION OF AN ANTENNA

BACKGROUND

1. Field of the Invention

This invention is directed to microwave antennas, in general, and to a two-axis antenna which can be stabilized relative to the feed assembly orientation, in particular.

2. Prior Art

There are many antenna systems known in the art. These antenna systems can be used in various information transmitting and/or receiving systems or the like and can be used for tracking and/or signalling. Most of the known antenna systems operate on a rotating basis to provide both the azimuth and elevation variable. This two-axis antenna system is usually arranged to be supported on bearings and driven by a motor gear-train apparatus. Thus, two degrees of rotation are achieved.

However, one problem that occurs in communications systems is that two or more datalink channels physically overlap and interfere with each other if more than one channel happens to be operating in the same geographical area. Clearly, it is quite desirable to isolate the interferring channels from each other. One method of isolation is using orthogonal linear polarization. This method works because orthogonal signals do not couple to each other.

In the past, many datalinks between antennas in a communications system have utilized circular polarization, inasmuch as this arrangement allows an airborne platform to maneuver without losing signal strength at the ground station. That is, the signal with circular polarization moves around; but does not tilt. Also, circular polarization provides some relief from multipath problems at low angles.

Nevertheless, in some applications orthogonal polarization is needed to counter the overlap problem. One approach in this regard is to use right-hand and left-hand circular polarization of signals because these signals are orthogonal to each other. Also, using dual linear polarization, with the individual linear polarizations at right angles to each other, produces signals with orthogonal polarization.

Of course, a problem with using circular polarization is that the circularity has to be devised and maintained extremely accurately. On the other hand, linear polarization requires the orientation of the two polarizations (for instance, vertical and horizontal) to be maintained very accurately with no tipping of the electromagnetic fields. That is, it must be recognized that the polarization of signals produced by airborne units which have a linear polarization will be tipped every time the airplane manuevers. More generally, in fact, tipping occurs almost any time that the antenna is moved and points in some other direction. Thus, it is required to devise some means to provide dual linear polarization wherein the polarization orientation can be maintained very accurately.

The desirability of increasing spectrum use efficiency of the data link arrangement by means of polarization isolation has been discussed recently. That is, utilization of two or more different signals on the same channel, but isolated from each other, increases the efficiency of the signal spectrum. Orthogonal polarization has long been used to provide the isolation between two signals on the same channel in the field of satellite communications (frequency reuse) and others.

It is also desirable to use polarization isolation for air-to-ground and air-to-air datalinks, but the polarization accuracy required for circular polarization is difficult to achieve for the airborne antenna. Because circular polarization is difficult to achieve, it would appear desirable to use linear polarization, and stabilize the polarization spatially. However, aircraft motion often causes rotation of linear polarization and results in cross-polarization coupling to the orthogonal channel. Therefore, what is needed is a means to stabilize the polarization axis as the aircraft maneuvers. The purpose of this invention is to accomplish this stabilization.

SUMMARY OF THE INSTANT INVENTION

An apparatus is provided which stabilizes the polarization axis of the antenna even as the platform (e.g. aircraft) maneuvers. That is, information about the attitude of the aircraft, including the antenna, and information about the position of the antenna, per se, is utilized to produce and provide a drive signal which is used to maintain the polarization axis in an arbitrary, fixed orientation. The drive signal depends upon the pointing angles of the antenna with respect to the frame of reference of the platform.

Electronic and mechanical implementations can be accomplished for different application requirements.

DESCRIPTION OF A PREFERRED EMBODIMENT

Figure 1:
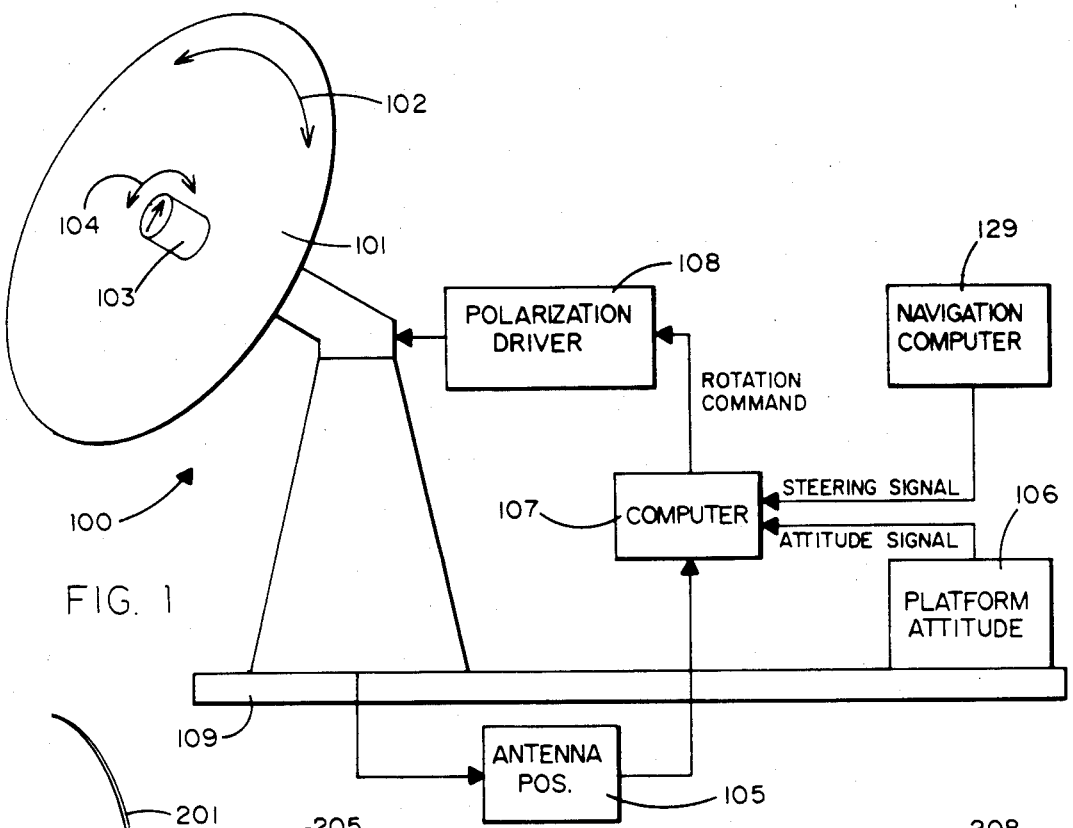
FIG. 1 is a schematic representation of an antenna system in accordance with the instant invention.

Referring now to FIG. 1, there is shown a schematic representation of a preferred embodiment of the instant invention. Device 100 is representative of an antenna apparatus which includes a support structure and all of the components thereof. Antenna apparatus 100 includes an antenna dish 101 which can be driven about its axis as indicated by arrow 102. Alternatively, the feed element 103 of antenna 100 can be rotated as indicated by arrow 104.

Conventional position detecting and monitoring means 105 is associated with the antenna 100. The monitoring means 105 can be of any suitable construction and can use electrical and/or mechanical apparatus to produce an "antenna position" output signal. That is, this "position" signal continuously monitors the position of the antenna relative to the platform (e.g. aircraft), represented by platform 109.

In similar fashion, the platform 109 on which the antenna 100 is supported (e.g. an aircraft) includes a suitable attitude sensing and monitoring apparatus 106. This apparatus 106 may also be of an electrical and/or mechanical construction and produces a "platform attitude" output signal. In a typical case, this attitude signal is representative of the attitude of an aircraft (or other airborne device) on which the antenna is mounted.

A computer 107 is connected to receive the "attitude" signal from apparatus 106 and the "position"

signal from monitoring means 105 and to operate on this information. The computer 107 performs relatively straightforward calculations to determine how to tilt the polarization of the radiated fields produced by the antenna to compensate for the tilt effected by the aircraft attitude and antenna position factors. The tilt of the fields is, therefore, calculated to cancel out the actual (or physical) tilt of the antenna 100 whereupon the polarization of the feed is properly maintained, either vertically or horizontally, as is desired or required.

The computer 107 supplies a "rotation command" signal to the polarization driver 108. The driver 108 supplies the appropriate signal to the antenna 100 so as to control the operation of the dish 101, the feed element 103 and/or the electronically applied feed signal so that the appropriate polarization signals and signal relationships are maintained.

By using computer 107 for performing this calculation, it becomes largely immaterial which way the antenna 100 is pointed. That is, the platform can move essentially unconstrained relative to the ground station. However, the computer 107 (and the input devices) monitor all of the changes that have been made, and perform the appropriate computations on these data to steer the antenna toward the ground station and maintain the polarization alignment. In some cases, the calculation is no more complicated than multiplying by the sine or the cosine of the angle of tilt for which compensation is required. While a look-up table might be used, the preferred embodiment uses real-time multiplication process for implementing the equations. In a simplified description, the operation is like a coordinate transform set of equations.

As discussed above, the operation can be accomplished mechanically. For example, see co-pending application Ser. No. 06/882,839, by R. A. Brown and L. N. Shestag, entitled ANTENNA STABILIZATION AND ENHANCEMENT BY ROTATION OF ANTENNA FEED, filed July 7, 1987 and assigned to the common assignee. Conversely, the operation can be performed electronically, depending on the requirements and purposes.

Figure 2:
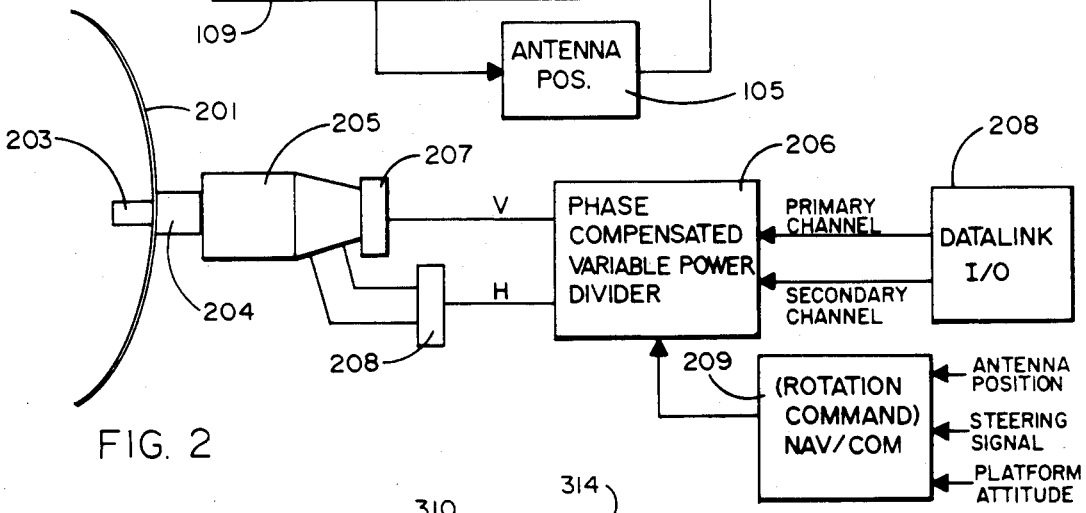
FIG. 2 is a more detailed schematic representation of one embodiment of the instant invention.

Referring now to FIG. 2 there is shown one embodiment of an electronic implementation of the invention. In this embodiment, the antenna apparatus is represented by a dish 201, a feed horn 204 and a feed element 203. Moreover, this embodiment uses an orthomode transducer 205 as a part of the antenna feed. An orthomode transducer permits operation with two inputs which are orthogonal to each other, for example, vertical and horizontal input signals. Moreover, the two orthogonal signals can be applied to the single feed apparatus while the isolation from each other is maintained. The orthogonal inputs to the transducer 205 are labelled "V" for vertical and "H" for horizontal, for convenience.

An electronically variable power divider with phase shift compensation 206 is used to drive the two orthogonal ports 207 and 208 of the orthomode transducer 205. Through the divider 206, the proper amount of either horizontal or vertical signal is applied to cancel out the tilt, which tilt converts some vertical signal to horizontal and vice versa. The electronically variable power divider 206 is driven by the rotation command signal which is derived from the calculations performed by computer 209 which is the functional equivalent of computer 107 in FIG. 1.

The main signal to the antenna apparatus is supplied to the power divider 206 at the input terminals. Typically, the input signals are supplied by the datalink 210. Moreover, for example, if a portion of the link is supposed to operate with the horizontal port as "H", the input signal passes through the divider 206 without being divided. That is, the H signal passes into the horizontal channel. Likewise, all of the V signal passes through the divider into the vertical channel.

The V and H signals from the divider 206 are, typically, supplied to the orthomode transducer 205 by means of suitable wave guide or coax couplers. Normally, the input power (i.e. RF input) from the datalink I/O unit 210 is supplied to either one port or the other (i.e. port V or port H) until a portion thereof is needed to drive the other port to compensate for a tilt. For example, if the aircraft or the antenna platform causes the antenna to tip, the horizontal polarization develops a vertical component. As a consequence, a portion of the input signal is divided by power divider 206 and supplied to the vertical port. That signal portion is exactly opposite to the signal portion which was caused by the tilt, the vertical signals cancel each other out, and the system is left with the horizontal signal only. Thus, there will be no interference to an adjacent communication link operating with vertical polarization.

The rotation command signal is produced at least in part by the calculation performed by computer 107. It is also representative of the navigation steering output signal from the navigational computer 209 and/or a part of the datalink signal. In other words, the polarization driver 108 in FIG. 1 controls the electronically variable power divider 206 and orthomode transducer 205 operates on the RF signal supplied by the power divider 206. That is, in general operation the platform (airplane) is moving (flying), and the antenna needs to be pointed to the reference (ground) station. Typically, the airplane has an on-board navigation system, or the like, that produces signals representative of the airplane attitude, as well as its location in space. The navigation computer 129 takes that information and calculates the direction in which to steer the antenna so that it continues to point at the ground station. This is performed by using the aircraft attitude and position signals to determine the steering angle for the antenna. This information is used to maintain the polarization properly oriented, in view of the aircraft attitude and position information.

Figure 3:
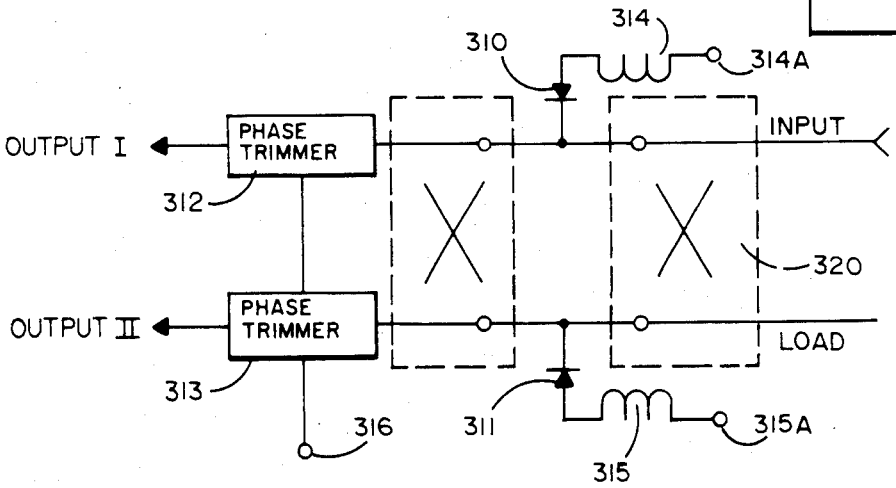
FIG. 3 is a schematic circuit diagram of one embodiment of an electronically variable phase splitter which can be used with the instant invention.

Referring now to FIG. 3, there is shown a typical implementation of the electronic power divider. The input signal is divided in half by a power splitter such as the 3 dB hybrid 320 (well known in the art) and both portions of the signal are phase shifted differentially by the diodes 310 and 311. The signals are then recombined in the second hybrid 321 and the relative output power at the two ports is determined by the differential phase shift. The power split can be varied continuously from one port to the other under control of the rotation command signal which is supplied as drive signals 314A and 315A via the coils 314 and 315 from computer 209 (see FIG. 2). Other implementations are described in the literature. (For example, reference is made to Low Loss Modulation Systems for Use in Antenna Array, U.S. Pat. No. 3,797,019.) Phase trimmers 312 and 313 using a compensation signal 316 are necessary to keep the output signals aligned, otherwise elliptical polarization (i.e. not linear) results.

Thus, in this invention contrary to the case of the mechanical implementation, the signal polarization is turned (not the feed elements) in order to compensate for the tilt. The electronic embodiment involves no moving parts. It is all electronic, solid state, with high reliability and many other desirable attributes and eliminates the need for motors, gears, synchros, wires and the like.

Thus, there is shown and described a method and apparatus for electronically controlling antenna pointing and signal transmission in such a fashion as to maintain an orthogonal relationhip between linearly polarized signals, as well as to maintain communication between signal units. The description herein is intended to be illustrative of a preferred embodiment. Any modifications or changes suggested by those skilled in the art, and which fall within the purview of the description are intended to be included therein as well. The description is intended to be illustrative only and is not intended to be limitative. The scope of the invention is limited only by the claims appended hereto.

We claim:

1. An antenna system which is capable of maintaining isolation between a pair of orthogonally polarized signals comprising, first means for operating on signals supplied thereto, orthomode transducer means for supplying signals to said first means, power means for supplying signals to said orthomode transducer means, control means for supplying signals to said power means for controlling the operation of said power means and the signals which are supplied to said orthomode transducer means by said power means, position sensing means for sensing the position of said antenna system, and attitude sensing means for sensing the attitude of said antenna system, said position sensing means and said attitude sensing means connected to supply input signals to said control means to produce control signals which are supplied to said power means.

2. The system recited in claim 1 wherein, said power means is an electronically controlled power mean.

3. The system recited in claim 1 wherein, said control means includes computer means.

4. The system recited in claim 3 wherein, said computer means determines the actual tilt, if any, of the antenna system and produces control signals to compensate therefor when supplied to said power means.

5. The system recited in claim 4 wherein, said power means receives said control signals from said computer means and operates to convert portions of the signals supplied by said power means to said orthomode transducer means thereby to cancel the effect of actual tilt.

6. The system recited in claim 3 wherein, said computer means performs a real-time multiplication process for producing control signals.

7. The system recited in claim 1 wherein, said orthomode transducer means receives signals with different polarization from said power means such that said signals are isolated from each other by polarization.

8. The system recited in claim 1 wherein, said first means includes at least a feed horn.

9. The system recited in claim 1 including, antenna dish means mounted to said first means such that said first means and said antenna dish means are movable with respect to each other.

10. The system recited in claim 1 including, platform means for supporting said antenna system.

11. The system recited in claim 1 wherein, at least one of said position sensing means and said altitude sensing means is capable of performing electrical sensing and supplying electrical input signals to said computer means.

12. The system recited in claim 1 including, source means for supplying input signals to said first means.

13. The system recited in claim 12 wherein, said source means comprises a datalink with an input-/output capability.

14. The system recited in claim 1 including, a pair of orthogonal input ports connected between said power means and said orthomode transducer means.

15. The system recited in claim 1 wherein, said power means includes power splitter circuitry.

16. The system recited in claim 15 wherein, said power splitter circuitry includes a pair of hybrid circuits connected to each other, and phase shifting means connected to each of said pair of hybrid circuits.

17. The system recited in claim 16 including, phase trimmers connected to the output of said power splitter circuitry.

* * * * *